US011952234B2

(12) United States Patent
Edwards

(10) Patent No.: US 11,952,234 B2
(45) Date of Patent: Apr. 9, 2024

(54) FOIL DISPENSING DEVICE

(71) Applicant: Brandi Edwards, Eugene, OR (US)

(72) Inventor: Brandi Edwards, Eugene, OR (US)

( * ) Notice: Subject to any disclaimer, the term of this patent is extended or adjusted under 35 U.S.C. 154(b) by 330 days.

(21) Appl. No.: 17/501,409

(22) Filed: Oct. 14, 2021

(65) Prior Publication Data

US 2023/0122762 A1 Apr. 20, 2023

(51) Int. Cl.
*B65H 35/00* (2006.01)
*B65H 16/00* (2006.01)

(52) U.S. Cl.
CPC ..... *B65H 35/0073* (2013.01); *B65H 16/005* (2013.01); *B65H 2301/5154* (2013.01); *B65H 2553/40* (2013.01); *B65H 2701/5114* (2013.01)

(58) Field of Classification Search
None
See application file for complete search history.

(56) References Cited

U.S. PATENT DOCUMENTS 3,293,967 A * 12/1966 Sharpe ..... B26D 5/24 83/369
4,417,495 A * 11/1983 Gordon ..... B26D 7/14 83/37
4,579,267 A * 4/1986 Planke ..... B65H 35/002 225/77
4,827,817 A * 5/1989 Grohoski ..... A47K 10/3637 83/241
5,082,159 A * 1/1992 Gutierrez ..... B65H 35/002 225/34
5,107,734 A * 4/1992 Armbruster ..... A47K 10/3612 83/205
5,292,046 A * 3/1994 Kaiser ..... B65H 35/0086 225/46
6,903,654 B2 6/2005 Hansen
7,987,756 B2 8/2011 Lewis
8,387,432 B2 3/2013 Ross
D860,674 S 9/2019 Young
2002/0003157 A1* 1/2002 Muir ..... B65H 35/04 225/11
2002/0074376 A1 6/2002 Polesuk
2004/0168995 A1 9/2004 Ignoffo
2008/0222894 A1* 9/2008 Borenslein ..... B26D 5/26 30/43.92
2009/0277919 A1* 11/2009 Ross ..... B65H 45/28 221/30
2017/0027393 A1* 2/2017 Barnes ..... A47K 10/36
2019/0374075 A1* 12/2019 Barnett ..... A61L 2/10

FOREIGN PATENT DOCUMENTS

WO WO2007113506 10/2007

* cited by examiner

*Primary Examiner* — William A. Rivera

(57) ABSTRACT

A foil dispensing device for on demand dispensing of sections of foil of a selectable length includes a housing comprising a lid that is hingedly engaged to a box so that the lid is positioned to selectively close an open top of the box. A motor is engaged to and positioned the box. A spindle is positionable in box to operationally engage the spindle to the motor. A roll of foil is positioned around spindle so that a free end of the roll of extends into a slot positioned in the housing. A motion sensor engaged to the housing and operationally engaged to the motor is actuated by motion of a hand of a user to signal the motor to rotate the spindle to dispense a section of the foil through the slot. A cutter positioned by the slot cuts the foil to separate the section from the roll.

12 Claims, 6 Drawing Sheets

FOIL DISPENSING DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to dispensing devices and more particularly pertains to a new dispensing device for on demand dispensing of sections of foil of a selectable length. The present invention discloses a dispensing device capable of selectively dispensing a section of foil having a prescribed length and having width that is determined by a width of a roll of foil that is loaded into the dispensing device. Actuation of the device is achieved by motion of a hand of a user proximate to a motion sensor.

(2) Description of Related Art Including Information Disclosed Under 37 CFR 1.97 and 1.98

The prior art relates to dispensing devices, which generally comprise devices capable of dispensing a sheet of material but do not allow control over a length or width of the sheet. What is lacking in the prior art is a dispensing device comprising a motion actuated motorized dispensing device for dispensing sections of foil wherein the length of the section to be dispensed can be selected and dispensing is activated when a hand is waved in front of a motion sensor.

(h) BRIEF SUMMARY OF THE INVENTION

An embodiment of the disclosure meets the needs presented above by generally comprising a housing, which in turn comprises a lid that is hingedly engaged to a box so that the lid is positioned to selectively close an open top of the box to define an interior space. A motor is engaged to the box and is positioned in the interior space. A spindle is selectively positionable in the interior space so that the spindle is operationally engaged to the motor and is rotationally engaged to the housing. A slot is positioned in the housing and extends in parallel to the spindle. A roll of foil is positioned around and is engaged to the spindle so that a free end of the roll of extends into the slot. A motion sensor is engaged to the housing and is operationally engaged to the motor. The motion sensor is configured to be actuated by motion of a hand of a user to signal the motor to selectively rotate the spindle to dispense a section of the foil from the roll through the slot. A cutter is engaged to the housing proximate to the slot and is positioned to selectively engage the foil positioned in the slot to separate the section from the roll.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
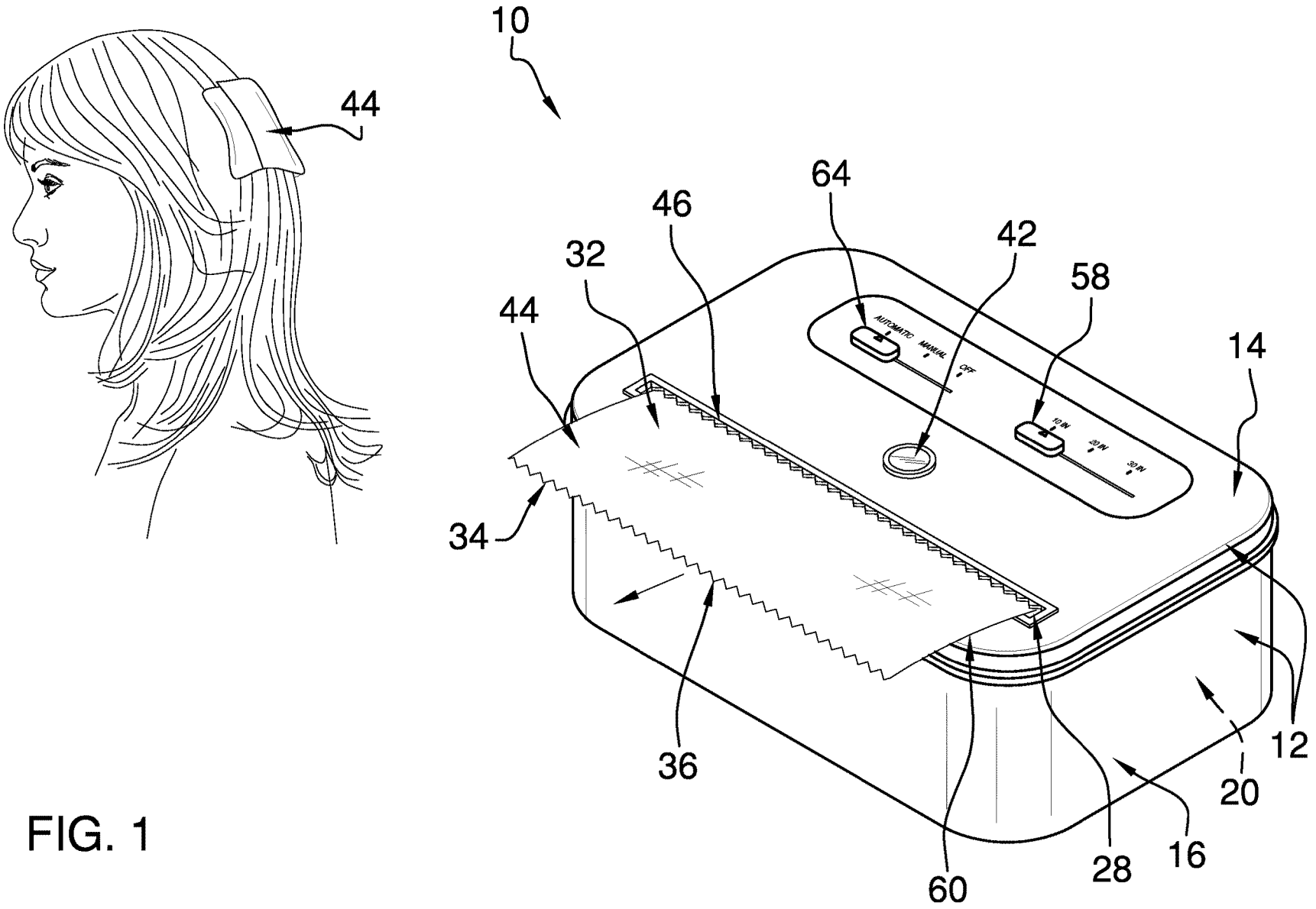
FIG. 1 is an isometric perspective view of a foil dispensing device according to an embodiment of the disclosure.
Figure 2:
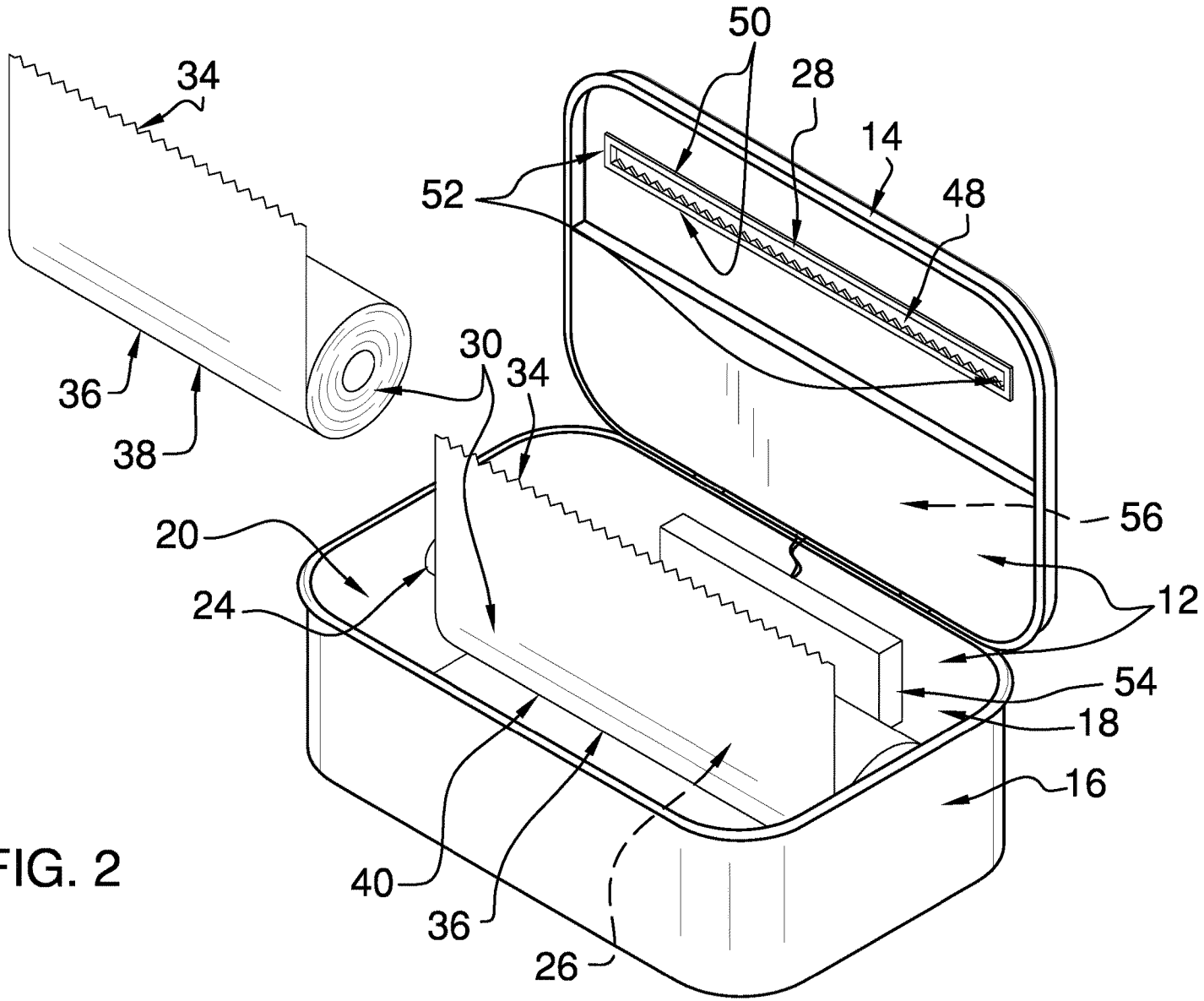
FIG. 2 is an isometric perspective view of an embodiment of the disclosure.

With reference now to the drawings, and in particular to FIGS. 1 through 6 thereof, a new dispensing device embodying the principles and concepts of an embodiment of the disclosure and generally designated by the reference numeral 10 will be described.

Figure 6:
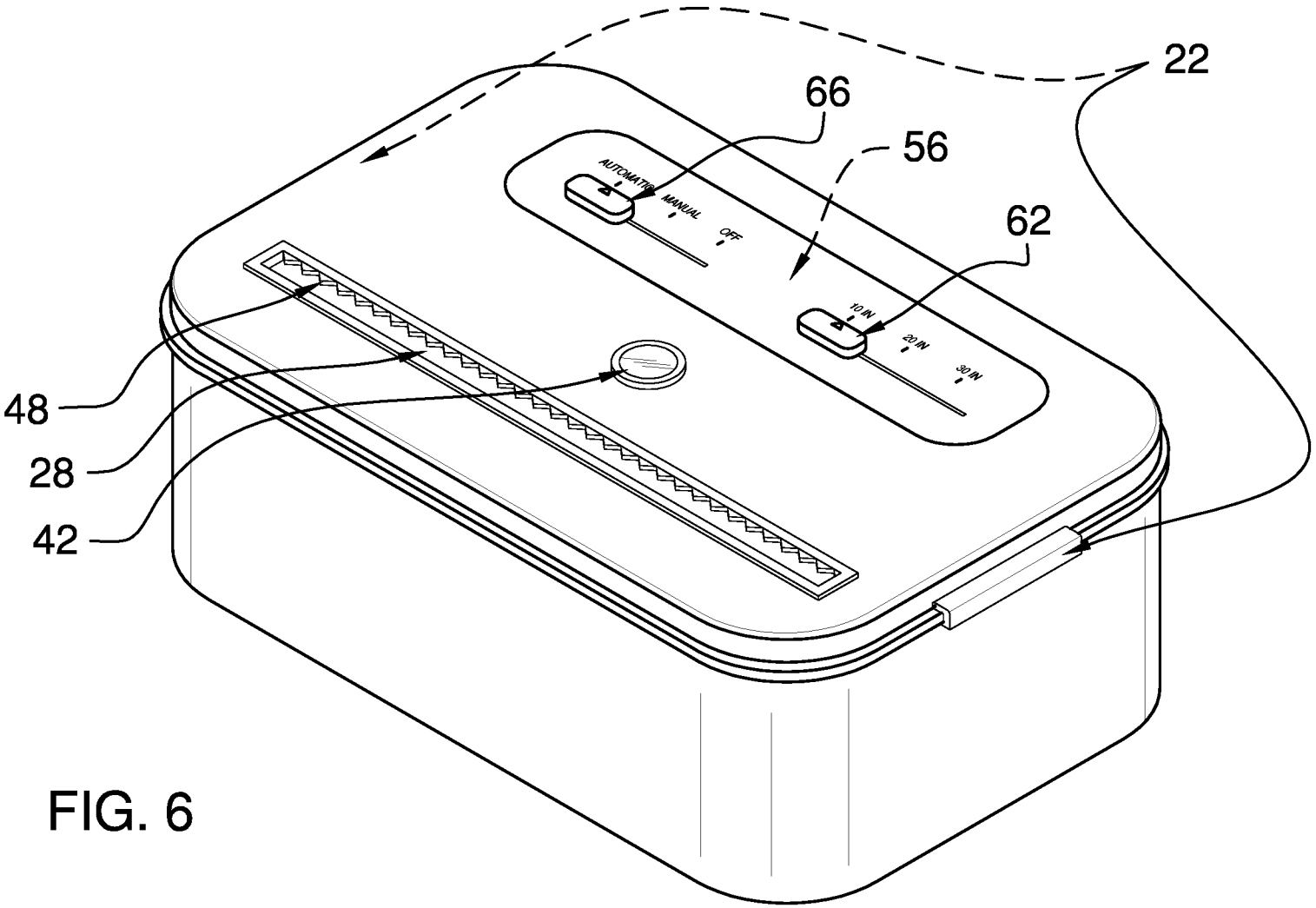
FIG. 6 is an isometric perspective view of an embodiment of the disclosure.

As best illustrated in FIGS. 1 through 6, the foil dispensing device 10 generally comprises a housing 12, which in turn comprises a lid 14 that is hingedly engaged to a box 16 so that the lid 14 is positioned to selectively close an open top 18 of the box 16 to define an interior space 20. The present invention also anticipates the lid 14 being selectively engageable to the box 16 by means of a pair of clips 22, as shown in FIG. 6.

A motor 24 is engaged to the box 16 and is positioned in the interior space 20. A spindle 26 is selectively positionable in the interior space 20 so that the spindle 26 is operationally engaged to the motor 24 and is rotationally engaged to the housing 12. A slot 28 is positioned in the housing 12 and extends in parallel to the spindle 26.

A roll 30 of foil 32 is positioned around and is engaged to the spindle 26 so that a free end 34 of the roll 30 of extends into the slot 28. The roll 30 of foil 32 is one of a plurality of rolls 30 of foil 32. Each roll 30 of foil 32 is selectively engageable to the spindle 26. Each roll 30 of foil 32 has a respective width 36 so that the plurality of rolls 30 of foil 32 comprises rolls 30 of foil 32 having a variety of widths 36. The plurality of rolls 30 of foil 32 may comprise a first roll 38 and a second roll 40, which have widths 36 of approximately 11.4 cm and 14.0 cm, respectively. The present invention also anticipates rolls 30 having other widths 36.

A motion sensor 42 is engaged to the housing 12 and is operationally engaged to the motor 24. The motion sensor 42 is configured to be actuated by motion of a hand of a user to signal the motor 24 to selectively rotate the spindle 26 to dispense a section 44 of the foil 32 from the roll 30 through the slot 28.

A cutter 46 is engaged to the housing 12 proximate to the slot 28 and is positioned to selectively engage the foil 32 positioned in the slot 28 to separate the section 44 from the roll 30. The cutter 46 comprises a blade 48, which is engaged to a respective opposed edge 50 of the slot 28 and extends between opposing ends 52 of the slot 28. The blade 48 is serrated. The user is positioned to grasp the section 44 of foil 32 protruding from the slot 28 and to lift the section 44 so that it engages the cutter 46 and is separated from the roll 30. The present invention also anticipates the cutter 46 comprising automated cutting means, such as sliding blades, pinching blades, and the like.

The present invention is anticipated to be useful to hair stylists when performing hair coloring operations using sections 44 of foil 32 to wrap locks of hair. The foil dispensing device 10 provides for on-demand dispensing of sections 44 of foil 32 and requires use of only one hand of the user to separate the foil 32 from the roll 30 using the cutter 46.

A battery 54 and a microprocessor 56 are engaged to the housing 12 and are positioned in the interior space 20. The microprocessor 56 is operationally engaged to the battery 54, the motor 24, and the motion sensor 42, positioning the microprocessor 56 to actuate the motor 24 upon receipt of a motion signal from the motion sensor 42. The present invention also anticipates the foil dispensing device 10 being powered by means of a power cord (not shown) that is configured to operationally engage the microprocessor 56 to a source of electrical current.

A size selector 58 is engaged to the housing 12 and is operationally engaged to the microprocessor 56. The size selector 58 is configured to be manipulated to signal the microprocessor 56 to actuate the motor 24 to dispense a section 44 of the foil 32 having a respective length 60. The size selector 58 enables the hair stylist to select a section 44 having a length 60 appropriate for a particular coloring operation. As a roll 30 of foil 32 having a width 36 appropriate the coloring operation can be installed in the housing 12, the hair stylist has control over both the length 60 and width 36 of the section 44 of foil 32.

Figure 3:
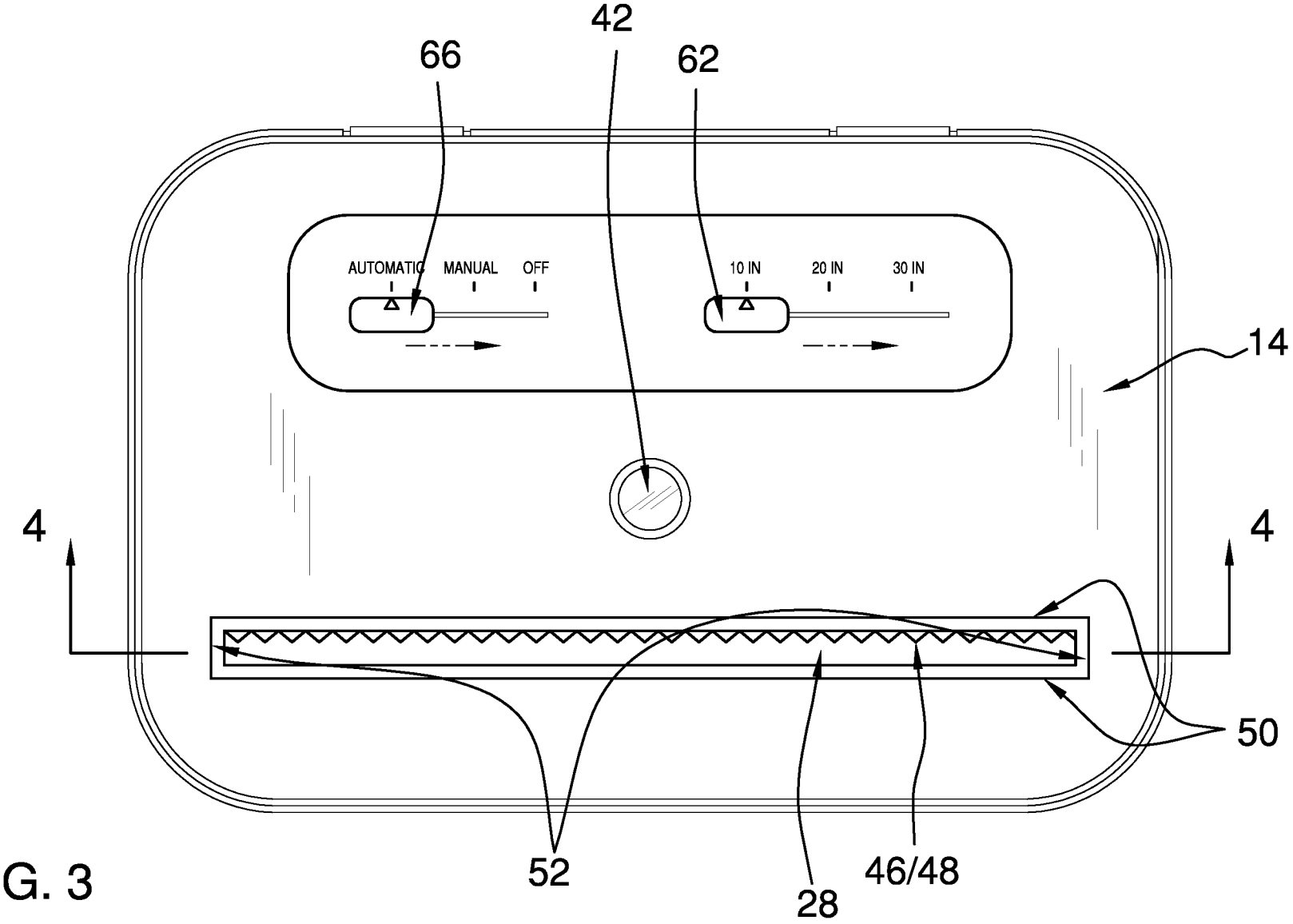
FIG. 3 is a top view of an embodiment of the disclosure.
Figure 4:
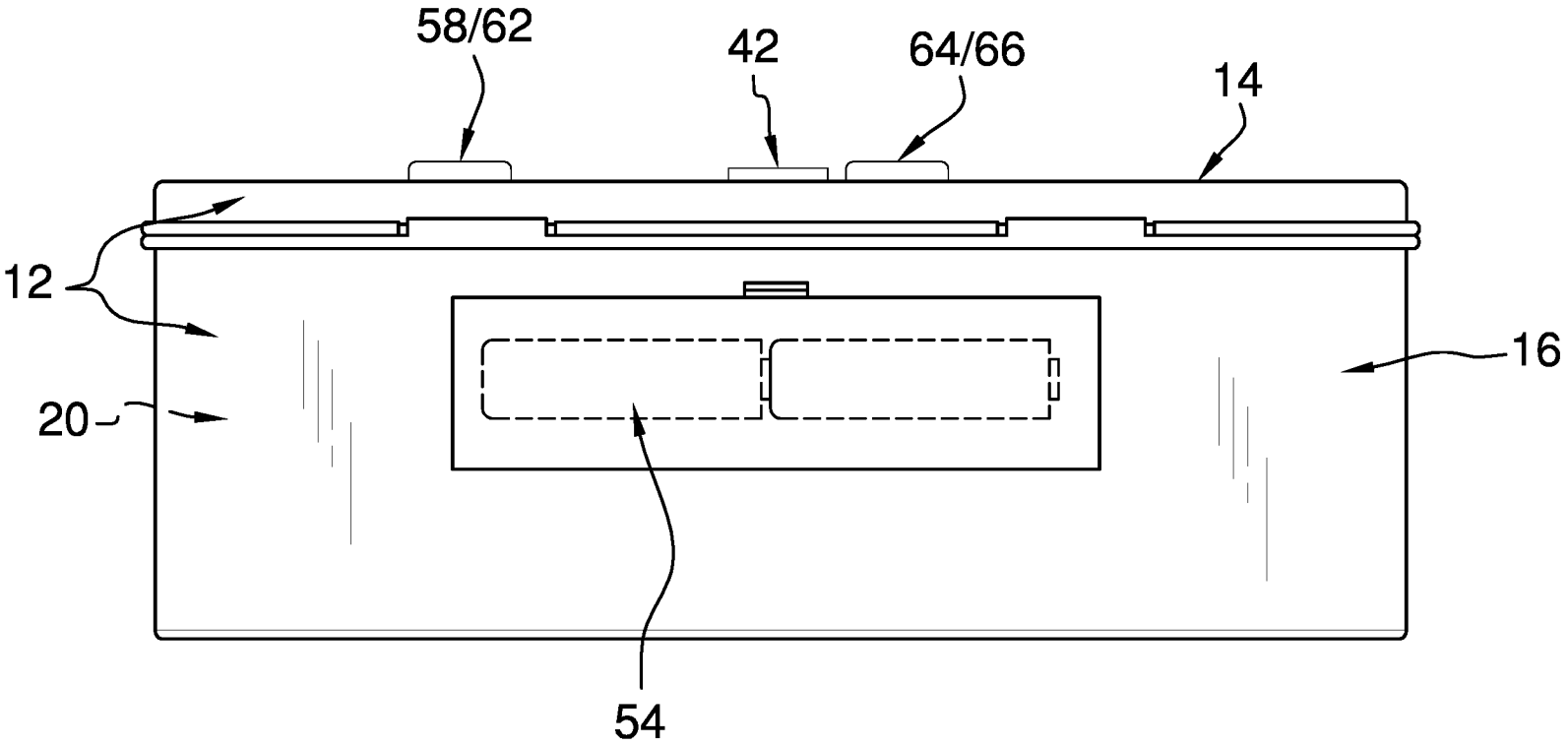
FIG. 4 is a rear view of an embodiment of the disclosure.
Figure 5:
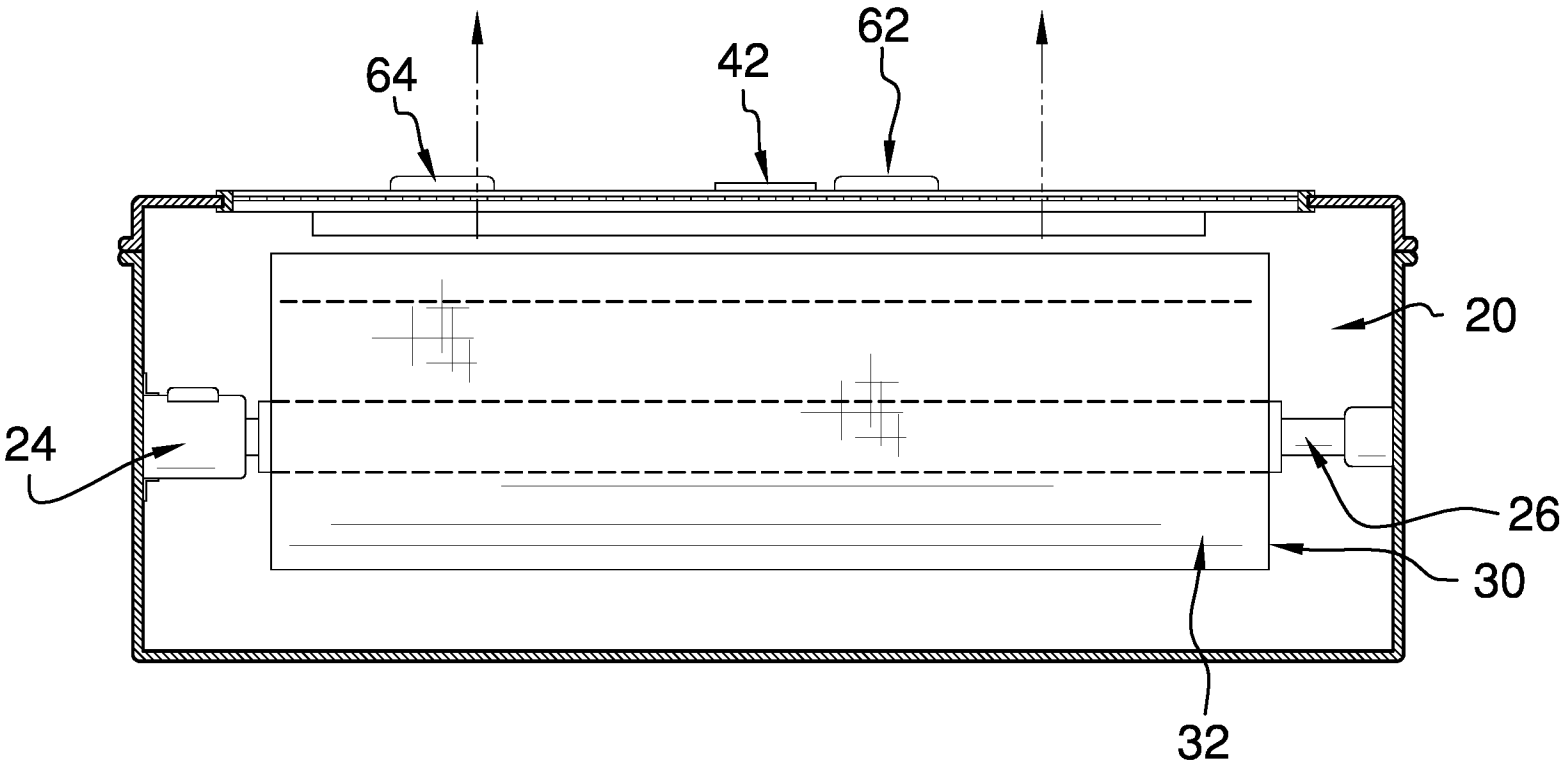
FIG. 5 is a cross-sectional view of an embodiment of the disclosure.

The size selector 58 may comprise a size slide switch 62, which is engaged to the lid 14 as shown in FIG. 3. The size slide switch 62 is selectively positionable in three positions, with each position corresponding to a section 44 of foil 32 having a respective length 60. The three positions of the size slide switch 62 may correspond to sections 44 of foil 32 having lengths 60 of approximately 25.4 cm, 50.8 cm, and 76.2 cm, or other lengths 60 as may be required. The present invention also anticipates the size selector 58 comprising other selection means, such as, but not limited to, dials, touch screens, and the like.

A mode selector 64 is engaged to the housing 12 and is operationally engaged to the microprocessor 56. The mode selector 64 is configured to be selectively switched to signal the microprocessor 56 to actuate the motor 24 intermittently, to actuate the motor 24 upon receipt of a motion signal from the motion sensor 42, and to turn the motor 24 off. The mode selector 64 may comprise a mode slide switch 66, which is engaged to the lid 14, as shown in FIG. 3. A notation of "Automatic" may be used to note a position of the mode slide switch 66 wherein the motor 24 is actuated intermittently to deliver sections 44 of foil 32 at set intervals. A notation of "Manual" may be used to note a position of the mode slide switch 66 wherein the motor 24 is actuated by the microprocessor 56 only upon receipt of a motion signal from the motion sensor 42. A notation of "OFF" may be used to note a position of the mode slide switch 66 wherein the motor 24 is not powered.

In use, a roll 30 of foil 32 having a desired width 36 is engaged to the spindle 26 and inserted into the housing 12 to engage it to the motor 24. The free end 34 of the roll 30 is inserted into the slot 28 and the lid 14 is closed. The size slide switch 62 is used to select a length 60 of the sections 44 to be dispensed. The mode slide switch 66 then is positioned to signal the microprocessor 56 to actuate the motor 24 either to dispense the sections 44 at intervals or only upon detection of motion by the motion sensor 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foil dispensing device comprising:

a housing comprising a box and a lid, the lid being hingedly engaged to the box, such that the lid is positioned for selectively closing an open top of the box for defining an interior space;

a motor engaged to the box and positioned in the interior space;

a spindle selectively positionable in the interior space, such that the spindle is operationally engaged to the motor and such that the spindle is rotationally engaged to the housing, a slot positioned in the housing and extending in parallel to the spindle;

a roll of foil positioned around and engaged to the spindle, such that a free end of the roll of extends into the slot;

a motion sensor engaged to the housing and being operationally engaged to the motor, wherein the motion sensor is configured for being actuated by motion of a hand of a user for signaling the motor for selectively rotating the spindle for dispensing a section of the foil from the roll through the slot;

a cutter engaged to the housing proximate to the slot, such that the cutter is positioned for selectively engaging the foil positioned in the slot for separating the section from the roll;

a battery engaged to the housing and positioned in the interior space;

a microprocessor engaged to the housing, positioned in the interior space, and being operationally engaged to the battery, the motor, and the motion sensor; and a mode selector engaged to the housing and being operationally engaged to the microprocessor, wherein the mode selector is configured for being selectively switched for signaling the microprocessor for actuating the motor intermittently, for actuating the motor upon receipt of a motion signal from the motion sensor, and for turning off the motor.

2. The foil dispensing device of claim 1, wherein the slot is positioned in the lid.

3. The foil dispensing device of claim 1, wherein the roll of foil is one of a plurality of rolls of foil, each roll of foil having a respective width, such that the plurality of rolls of foil comprises rolls of foil having a variety of widths, each roll of foil being selectively and interchangeably engageable to the spindle.

4. The foil dispensing device of claim 3, wherein the plurality of rolls of foil comprising a first roll and a second roll having widths of approximately 11.4 cm and 14.0 cm, respectively.

5. The foil dispensing device of claim 1, wherein the motion sensor is engaged to the lid.

6. The foil dispensing device of claim 1, wherein the cutter comprises a blade engaged to a respective opposed edge of the slot and extending between opposing ends of the slot.

7. The foil dispensing device of claim 6, wherein the blade is serrated.

8. The foil dispensing device of claim 1, further including a size selector engaged to the housing and being operationally engaged to the microprocessor, wherein the size selector is configured for being manipulated for signaling the microprocessor for actuating the motor for dispensing a section of the foil having a respective length.

9. The foil dispensing device of claim 1, wherein the mode selector comprises a mode slide switch engaged to the lid.

10. A foil dispensing device comprising:

a housing comprising a box and a lid, the lid being hingedly engaged to the box, such that the lid is positioned for selectively closing an open top of the box for defining an interior space;

a motor engaged to the box and positioned in the interior space;

a spindle selectively positionable in the interior space, such that the spindle is operationally engaged to the motor and such that the spindle is rotationally engaged to the housing, a slot positioned in the housing and extending in parallel to the spindle;

a roll of foil positioned around and engaged to the spindle, such that a free end of the roll of extends into the slot;

a motion sensor engaged to the housing and being operationally engaged to the motor, wherein the motion sensor is configured for being actuated by motion of a hand of a user for signaling the motor for selectively rotating the spindle for dispensing a section of the foil from the roll through the slot;

a cutter engaged to the housing proximate to the slot, such that the cutter is positioned for selectively engaging the foil positioned in the slot for separating the section from the roll;

a size selector engaged to the housing and being operationally engaged to the microprocessor, wherein the size selector is configured for being manipulated for signaling the microprocessor for actuating the motor for dispensing a section of the foil having a respective length; and wherein the size selector comprises a size slide switch engaged to the lid, the size slide switch being selectively positionable in three positions, with each position corresponding to a section of foil having a respective length.

11. The foil dispensing device of claim 10, wherein the three positions of the size slide switch correspond to sections of foil having lengths of approximately 25.4 cm, 50.8 cm, and 76.2 cm.

12. A foil dispensing device comprising:

a housing comprising a box and a lid, the lid being hingedly engaged to the box, such that the lid is positioned for selectively closing an open top of the box for defining an interior space;

a motor engaged to the box and positioned in the interior space;

a spindle selectively positionable in the interior space, such that the spindle is operationally engaged to the motor and such that the spindle is rotationally engaged to the housing;

a slot positioned in the housing and extending in parallel to the spindle, the slot being positioned in the lid;

a roll of foil positioned around and engaged to the spindle, such that a free end of the roll of extends into the slot, the roll of foil being one of a plurality of rolls of foil, each roll of foil having a respective width, such that the plurality of rolls of foil comprises rolls of foil having a variety of widths, each roll of foil being selectively and interchangeably engageable to the spindle, the plurality of rolls of foil comprising a first roll and a second roll having widths of approximately 11.4 cm and 14.0 cm, respectively;

a motion sensor engaged to the housing and being operationally engaged to the motor, wherein the motion sensor is configured for being actuated by motion of a hand of a user for signaling the motor for selectively rotating the spindle for dispensing a section of the foil from the roll through the slot, the motion sensor being engaged to the lid;

a cutter engaged to the housing proximate to the slot, such that the cutter is positioned for selectively engaging the foil positioned in the slot for separating the section from the roll, the cutter comprising a blade engaged to a respective opposed edge of the slot and extending between opposing ends of the slot, the blade being serrated;

a battery engaged to the housing and positioned in the interior space;

a microprocessor engaged to the housing, positioned in the interior space, and being operationally engaged to the battery, the motor, and the motion sensor;

a size selector engaged to the housing and being operationally engaged to the microprocessor, wherein the size selector is configured for being manipulated for signaling the microprocessor for actuating the motor for dispensing a section of the foil having a respective length, the size selector comprising a size slide switch engaged to the lid, the size slide switch being selectively positionable in three positions, with each position corresponding to a section of foil having a respective length, the three positions of the size slide switch corresponding to sections of foil having lengths of approximately 25.4 cm, 50.8 cm, and 76.2 cm; and a mode selector engaged to the housing and being operationally engaged to the microprocessor, wherein the mode selector is configured for being selectively switched for signaling the microprocessor for actuating the motor intermittently, for actuating the motor upon receipt of a motion signal from the motion sensor, and for turning off the motor, the mode selector comprising a mode slide switch engaged to the lid.

* * * * *